US007448110B2

(12) United States Patent
Best et al.

(10) Patent No.: US 7,448,110 B2
(45) Date of Patent: Nov. 11, 2008

(54) FIRE HOSE RETRIEVAL WINCH

(76) Inventors: G. Robert Best, 5144 Woodrun, Mount Gilead, NC (US) 27306; Brian C. Proctor, 365 College Blvd., Thomasville, NC (US) 27360

( * ) Notice: Subject to any disclaimer, the term of this patent is extended or adjusted under 35 U.S.C. 154(b) by 920 days.

(21) Appl. No.: 10/867,709

(22) Filed: Jun. 16, 2004

(65) Prior Publication Data

US 2005/0011979 A1 Jan. 20, 2005

Related U.S. Application Data

(60) Provisional application No. 60/487,192, filed on Jul. 15, 2003.

(51) Int. Cl.
*B65H 75/00* (2006.01)

(52) U.S. Cl. ..... 15/40; 15/34; 15/52

(58) Field of Classification Search ..... 15/40, 15/34, 52, 79.2; 242/370, 398, 371; 239/195; 134/122 R See application file for complete search history.

(56) References Cited

U.S. PATENT DOCUMENTS

| | | | | |
|---|---|---|---|---|
| 3,866,532 | A | 2/1975 | Ogden, Jr. | |
| 4,057,198 | A | 11/1977 | Whitfield | |
| 4,117,991 | A | 10/1978 | Johnson | |
| 4,198,010 | A * | 4/1980 | Knapp | 242/532.6 |
| 4,206,526 | A | 6/1980 | Bertram | |
| 4,280,672 | A * | 7/1981 | Santos et al. | 242/534.2 |
| 4,452,135 | A | 6/1984 | Hayes | |
| 4,592,519 | A | 6/1986 | Peacock | |
| 4,723,568 | A | 2/1988 | Adams | |
| 4,732,345 | A | 3/1988 | Golden | |
| 5,040,259 | A * | 8/1991 | Ishii et al. | 15/40 |
| 5,113,884 | A * | 5/1992 | Melgeorge | 134/122 R |
| 5,349,763 | A | 9/1994 | Hafenrichter et al. | |
| 5,356,480 | A | 10/1994 | Melgeorge | |
| 5,988,559 | A | 11/1999 | Gnass | |
| 6,241,175 | B1 * | 6/2001 | Nichols | 242/395 |
| 6,487,750 | B1 | 12/2002 | Brown | |
| 7,240,707 | B1 * | 7/2007 | Schweitzer | 144/286.5 |
| 2005/0011979 | A1 * | 1/2005 | Best et al. | 242/370 |
| 2008/0025828 | A1 * | 1/2008 | Strasssman et al. | 414/462 |

FOREIGN PATENT DOCUMENTS

| | | |
|---|---|---|
| DE | 4214925 | 10/1993 |
| JP | 1-119269 | 5/1989 |
| JP | 4-253869 | 9/1992 |

* cited by examiner

*Primary Examiner*—Lee D Wilson
(74) *Attorney, Agent, or Firm*—Richard C. Litman

(57) ABSTRACT

The fire hose retrieval winch includes an elongated, rigid hose processing channel having a generally C-shaped cross section and open inlet and outlet ends, with the open side forming a lateral hose insertion and removal slot. An electrically powered drive roller draws the hose through the device, with a clamping roller bearing adjustably against the opposite side of the hose to provide tractive friction for the hose against the drive roller. The inlet end of the device may include opposed brushes for mechanically removing foreign matter from a hose passing therethrough, and opposed water nozzles for washing foreign matter from the hose. The hose retrieval winch is relatively small and portable and is installed removably in the existing trailer hitch of a vehicle to draw a deployed fire hose back to the vehicle for placement on the vehicle, with the device simultaneously cleaning the hose during the operation.

18 Claims, 4 Drawing Sheets

FIRE HOSE RETRIEVAL WINCH

CROSS-REFERENCE TO RELATED APPLICATION

This application claims the benefit of U.S. Provisional Patent Application Ser. No. 60/487,192, filed Jul. 15, 2003.

BACKGROUND OF THE INVENTION

1. Field of the Invention

The present invention relates generally to powered mechanisms for retrieving an article and/or drawing the article therethrough for placement or storage. More specifically, the present invention relates to a low voltage, electrically powered winch for retrieving a fire hose or similar article after use, compressing and cleaning the hose, and positioning the hose for storage on the back of a fire truck or other storage area.

2. Description of the Related Art

Fire and similar hoses tend to have relatively heavy construction, due to the need for durability and damage resistance as well as their generally large diameters for the hoses can reach diameters of up to six inches, and a single length of hose may weigh in excess of one hundred pounds. These hoses are generally stacked in the bed of a fire truck in a sinusoidal pattern to permit rapid deployment of the hose at the scene of a fire.

The retrieval and storage of the hose after use is a different matter, however. The hose has generally become somewhat soiled during use, and has often picked up dirt, sand, gravel, and other foreign matter. Moreover, there is almost always some water remaining in the hose, which increases its weight even further. Even when the water has completely drained from the hose, the hose must still be compressed to its normally flattened state when in storage, to provide for compact storage on the truck bed or elsewhere as desired.

As a result of the above conditions, several mechanized or powered devices have been developed in the past in attempts to facilitate the retrieval, cleanup, and storage of fire hoses and similar articles. Many, if not most, such devices simply roll the hose up on a central reel. This is not desirable, as it is not convenient to deploy the hose rapidly for use from a rolled configuration. Other devices have been such devices generally do not provide for the takeup and storage of the hose after the cleaning operation. Where such devices do provide for hose takeup and cleaning, they generally either roll the hose, or provide only a single cleaning method which may not be sufficiently thorough, or are permanently mounted to a vehicle or other structure, which results in the device obstructing other operations when it is not needed.

Accordingly, a need will be seen for a portable fire hose retrieval winch, which may be removably secured to the back of a truck or other suitable area for retrieving a hose for storage. The device itself is easily removed from its installation point for storage on or in the truck or other area, as desired. The present fire hose retrieval winch utilizes vehicle electrical power rather than power from the electrical utility grid, as a fire-fighting vehicle is always available when a fire is being fought and electrical grid power may be interrupted due to the fire, or nonexistent. The use of a relatively low voltage power is also considerably safer than higher voltage from the electrical utility grid, for devices operating in the presence of water. The present retrieval winch may also provide both mechanical (brushing) and hydraulic (water spray) cleaning of the hose as it passes through the machine, if so desired.

A discussion of the related art of which the present inventors are aware, and its differences and distinctions from the present invention, is provided below.

U.S. Pat. No. 3,866,532 issued on Feb. 18, 1975 to Grant M. Ogden, Jr., titled "Firehose Retractor", describes a relatively costly and complex device having dual opposed drive rollers in at least one embodiment thereof. The upper roller is installed in an openable frame, and swings open with the movable portion of the frame for placement of the hose between the movable upper roller and the fixed lower drive roller. While the powered hose retraction mechanism itself is portable and removable from the back of the vehicle upon which it is installed, Ogden, Jr. requires a permanently installed lateral track having a laterally movable structure attached thereto, to which his retraction mechanism attaches. In contrast, the present hose retrieval device may be fitted to the top of a length of offset pipe or the like, which is in turn mounted on a swivel base which secures in a conventional receiver type trailer hitch fitting. This allows the present retrieval device distributing the hose. Yet, the entire apparatus is easily removed from the receiver hitch for storage. Moreover, Ogden, Jr. utilizes a relatively complex and costly set of bevel gears to power at least one, or both, drive roller(s) in his device. In contrast, the present retrieval device utilizes an economical sprocket and chain drive system. Even with its economies of construction in comparison to the Ogden, Jr. device, the present device still provides additional utility over the Ogden, Jr. device by means of the dual cleaning principles used, i.e. brushes and water washdown. Ogden, Jr. does not disclose any provision for water washdown of a hose in his device.

U.S. Pat. No. 4,057,198 issued on Nov. 8, 1977 to Bert D. Whitfield, titled "Fire Hose Winding Apparatus," describes a frame mounted on rollers or wheels, with a hose takeup reel located at the upper and generally central portion thereof. The Whitfield device (1) does not attach to a vehicle; (2) is not electrically powered, but requires manual input to the reel; (3) does not pass the hose therethrough for distribution as desired, but winds the hose on the reel; and (4) does not provide any means for cleaning the exterior of the hose. The Whitfield hose reel is thus not particularly closely U.S. Pat. No. 4,117,991 issued on Oct. 3, 1978 to Roy E. Johnson, titled "Hose Winding Mechanism," describes a portable box structure having an electric takeup motor therein. A reel extends from the box for winding the hose thereon. However, Johnson does not provide any means for securing his device either temporarily or permanently to a vehicle, does not pass the hose therethrough for distribution or storage as desired, and does not provide any means for cleaning the hose before it is reeled up. The electrical power source is clearly intended to be from the local electrical power grid, in accordance with the electrical extension cord 16 shown in FIGS. 1 through 3 of the drawings in the Johnson U.S. Patent; no low voltage operation from a vehicle electrical system is disclosed by Johnson.

U.S. Pat. No. 4,198,010 issued on Apr. 15, 1980 to Orville J. Knapp, titled "Hose Winding Apparatus," describes a vertical reel, i.e. a device for reeling or coiling the hose on a horizontal axis. As in the other reels discussed above, the Knapp device does not pass the hose therethrough for distributing on a truck or the like for future deployment, as does the present invention. Moreover, Knapp does not disclose any means of attaching his device to a truck or other vehicle, either temporarily or permanently, and he does not disclose any means of cleaning the hose before it is coiled on the reel. It is also noted that Knapp prefers to use relatively high voltage for his electrical power source (column 4, lines 7-9), rather than the low voltage power available from a fire truck or other vehicle, as is used by the present hose retrieval device.

U.S. Pat. No. 4,206,526 issued on Jun. 10, 1980 to Francis E. Bertram, titled "Hose Washing Machine," describes an electrically powered machine having opposed rotating brushes between which the hose is drawn, and water and detergent washing of the hose. However, Bertram does not disclose any means of temporarily securing his device to a fire truck or other vehicle, as provided by the present invention. Most importantly, Bertram does not disclose any powered means for drawing the hose through his cleaning machine; the hose apparently must be drawn through the Bertram machine by hand. In contrast, the present machine serves to retrieve a deployed hose to pass the hose onto a truck or other storage area, and simultaneously cleans the hose as it passes through the retrieval winch.

U.S. Pat. No. 4,280,672 issued on Jul. 28, 1981 to Frank Santos et al., "Compact Fire Hose And Winder," describes a relatively complex device having dual opposed reels extending to each side thereof. One side includes a pair of opposed oscillating brushes to scrub the opposite sides of the flattened hose as it is drawn therebetween by the takeup reel. Water washdown and a detergent spray are also provided. However, Santos et al. do not provide any means for securing their device to a truck or other vehicle. Such attachment means is unnecessary for such a device which only reels the hose(s), rather than passing them through the device for retrieval on or in a truck bed or the like, as the present device does. Moreover, the Santos et al. device utilizes a relatively complex gearbox having two right angle outputs, with one providing power for the axle for the two reels and the other providing power for the oscillating brushes.

U.S. Pat. No. 4,452,135 issued on Jun. 5, 1984 to Robert H. Hayes, titled "Fire Hose Retracting And Flattening Apparatus," describes a portable device which attaches removably to the back of a truck or the like, and which includes a motorized drive for pulling a fire hose therethrough for placement on the truck. However, the Hayes apparatus is quite complex, and includes multiple chain and belt drives. One of the drives extend to a pair of rollers at the distal end of one of a pair of opposed, arcuately pivotable arms, which alternately contact the hose depending upon the passage of a relatively larger diameter coupling therethrough. The present device does not permit the passage of the hose couplings therethrough, but is configured to retrieve and clean only one section of hose at a time. This permits the present device to be considerably simpler and more economical than the Hayes apparatus, with the present device accomplishing more functions (i.e., cleaning the hose as well, using one or two principles) than the Hayes apparatus.

U.S. Pat. No. 4,592,519 issued on Jun. 3, 1986 to Roy A. Peacock, titled "Hose Roller," describes a device having a structure primarily formed of pipe. A fitting adapted for removable installation in a receiver type hitch is provided at the lower end thereof. No powered takeup means is provided; the Peacock device is manually operated and is as the title of the patent indicates, a takeup reel which rolls the hose thereon rather than a retrieval device for drawing the hose therethrough for placement on a truck or the like. Moreover, Peacock does not disclose any hose cleaning means with his device.

U.S. Pat. No. 4,723,568 issued on Feb. 9, 1988 to Truman W. Adams, titled "Hose Reel Mechanism," describes a dual reel system in which a lower reel is rotated mechanically by traction from wheels traveling over the surface as the device is rolled over the ground. The upper reel is rotated by hand as desired. The Adams device is adapted for use with garden hoses and the like, and is not configured for attachment to a vehicle and does not include any form of powered operation or means for cleaning off the hose as it is wound upon the reels.

U.S. Pat. No. 4,732,345 issued on Mar. 22, 1988 to Sammy L. Golden, titled "Hose Reel," describes a device in which the two opposed reel flanges or side plates are adjustable relative to one another, to adjust the width of the reel for different widths of hoses. However, both the reel width adjustment and the reel rotation are manually operated; no powered means is provided. The provision of a reel, rather than drawing the hose through the device for positioning as desired, the lack of powered operation, and the lack of means for cleaning the hose, are different from the present hose retrieval device.

U.S. Pat. No. 5,040,259 issued on Aug. 20, 1991 to Keisuke Ishii et al., titled "Fire Hose Washing Apparatus," describes several embodiments of a relatively complex device which draws two or more lengths of connected hose, and their connectors, through a series of rotary brushes and wash stations. The Ishii et al. device includes a series of sensors to detect the large diameter hose section connectors as they pass through the apparatus, and mechanisms for lifting the rollers, brushes, and other components to provide clearance for the hose connectors. While the Ishii et al. device is portable, having wheels mounted beneath its cabinet, no means is apparent for securing the device removably to a fire truck or the like for loading the hose into the truck as it is retrieved and cleaned, as provided by the present retrieval winch.

U.S. Pat. No. 5,349,763 issued on Sep. 27, 1994 to Karl Hafenrichter et al., titled "Apparatus For Drying Hoses, Particularly Fire Hoses," describes a device which is apparently permanently installed at a fire station or the like, for drying fire hoses after they are returned from use at a fire. The Hafenrichter et al. machine includes rollers for winding the hose through the machine, a heating subassembly to more readily evaporate water from the hose, suction devices to draw the water from the surface of the hose, and other components. However, Hafenrichter et al. do not disclose any portability for their device, nor do they disclose any means of cleaning a hose using their machine. In fact, the Hafenrichter et al. device teaches away from the present hose retrieval winch, by removing water from the surface of the hose rather than washing down the surface, as may be accomplished by the present invention.

U.S. Pat. No. 5,356,480 issued on Oct. 18, 1994 to Edward L. Melgeorge, titled "Method Of Washing Hose," describes a relatively complex device including sensors and limit switches for determining when a relatively large diameter hose coupling enters the machine, and shutting off the machine. While Melgeorge provides for washing the surface of the hose with high pressure water, he does not provide any mechanical cleaning means (e.g., brushes, etc.), as provided in the present invention. Thus, Melgeorge is required to use relatively high pressure wash water to blast the surface of the hose clean, rather than being able to use relatively low pressure water from a local water supply, as is the case with the present invention. Moreover, Melgeorge does not disclose any portability nor means for removably securing his machine to a fire truck or other vehicle, as is provided with the present invention.

U.S. Pat. No. 5,988,559 issued on Nov. 23, 1999 to Justin A. Gnass, titled "Fire Hose Winding Apparatus," describes a reel comprising four radially adjustable arms, for adjusting the diameter of the hose spool or reel which is wound thereon. The apparatus may be secured removably to the back bumper of a truck or other vehicle as desired, and swivels to a position adjacent the back of the vehicle for storage when not in use.

The Gnass reel is manually cranked and does not include any means for passing the hose therethrough for storage in an adjacent area, nor for cleaning the hose during the process, which features are a part of the present invention.

U.S. Pat. No. 6,487,750 issued on Dec. 3, 2002 to Terry A. Brown, titled "Hose Cleaning Device," describes a generally cubical box-like structure having interchangeable, circular entry and exit ports on opposite sides. A pair of circular wiping seals is installed within the box, along with a centrally located sprayer assembly configured to spray water radially inwardly toward a hose being drawn through the device. The Brown device teaches away from the present invention, in that Brown cannot use opposed cylindrical rollers to draw a hose having a circular cross section therethrough. Brown avoids this problem by failing to include any means whatsoever for drawing a hose through his device; all motive power for moving a hose through the Brown device, must be applied externally by separate means. While Brown implies that his device is portable, he does not disclose any specific means for attaching it to another device for use. In contrast, the present invention includes means for drawing a flat hose therethrough using cylindrical rollers, means for mechanically brushing the hose as well as washing the exterior surface of the hose, means for collapsing and compressing the hose for compact and relatively light weight storage, and means for removably attaching the device to a fire vehicle or the like.

Japanese Patent Publication No. 1-119,269 published on May 11, 1989 to Showa Kiki Sangyo KK, titled "Fire Hose Washing Apparatus," describes (according to the drawings and English abstract) a relatively complex device completely contained within a portable cabinet. A dispensing reel and a takeup reel are contained within the cabinet, with a series of drive, idler, brush, and other rollers disposed within the cabinet as well, with a complex series of belts extending therebetween to drive all of the various rollers and reels. No means is apparent for mounting the device upon a fire fighting vehicle, nor for dispensing the hose therefrom onto or into the vehicle, as provided by the present invention.

Japanese Patent Publication No. 4-253,869 published on Sep. 9, 1992 to Ogura Clutch Co. Ltd., titled "Fire Hose Take-Up Device," describes (according to the drawings and English abstract) a portable cabinet for rolling the hose on a reel. The disclosure is primarily directed to a means for avoiding jamming of the motor in the event of excessive tension during the winding and reeling operation, and also a means for withdrawing the forked hub from the center of the coiled hose after it has been wound. No means for cleaning the hose, mounting the device on a fire fighting or other vehicle, nor for passing the hose through the device for distribution and placement, is apparent in the '869 Japanese Patent Publication.

Finally, German Patent Publication No. 4,214,925 published on Oct. 7, 1993 to Heinz Bormann, titled "Fire Hose Coiling Machine . . . ," describes (according to the drawings and English abstract) a cabinet having a pair of takeup reels therein. One of the reels grips the hose at its centerpoint, and winds the hose thereon toward both ends simultaneously. No means of mounting the device on a fire vehicle or the like for portability, washing or otherwise cleaning the hose, or passing the hose through the device for placement and storage in another area, is apparent in the '925 German Patent Publication.

None of the above inventions and patents, taken either singly or in combination, is seen to describe the instant invention as claimed. Thus a fire hose retrieval winch solving the aforementioned problems is desired.

SUMMARY OF THE INVENTION

The present fire hose retrieval winch is a relatively compact and portable device which may be secured removably to the structure of a fire truck or other vehicle for use. Notwithstanding its compact size and portability, the present fire hose winch is a multifunction device, i.e., it serves to draw a deployed hose back to the truck or vehicle for repositioning and storage thereon or therein, and also cleans the exterior surface of the hose using brushes and/or water washdown, as desired.

The primary structure of the present hose winch comprises an elongated, rigid channel having a generally C-shaped cross section and open inlet and outlet ends, with the open side of the channel forming a lateral hose insertion and removal slot in the device. A drive motor and controller are located in a separate structure beneath the primary hose processing channel, with the motor and controller preferably receiving power from the conventional twelve volt DC electrical system of the vehicle to which the device is temporarily secured. A mounting stand removably attaches to the bottom of the device beneath the motor and power supply therefor, with the opposite, lower end of the mounting stand including a fitting for removably securing the stand to a conventional receiver type trailer hitch socket on a vehicle.

The drive motor operates a transverse drive roller in the hose channel by means of a chain drive. A non-driven clamping roller is adjustably positioned slightly above and ahead (in the sense of hose travel through the device) of the drive roller, and is spring loaded to apply pressure toward the drive roller to grip a hose or other object therebetween. The spring pressure allows relatively small foreign objects (e.g., gravel, etc.) which may have adhered to the hose, to pass through the rollers without damage to the device or to the hose. Finally, a non-driven support roller extends across the interior of the hose channel toward the inlet end of the device to support the hose at that location.

The inlet end of the device may include opposed, replaceable upper and lower brushes removably installed thereacross, to brush off any substantial foreign matter from the upper and lower surfaces of the hose as it enters the device. An upper and a lower spray nozzle are positioned within the channel at the brush location, to wash down the respective surfaces of the hose. Water may be supplied by means of a conventional garden hose or the like using water from a standard municipal supply, or other source as appropriate.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
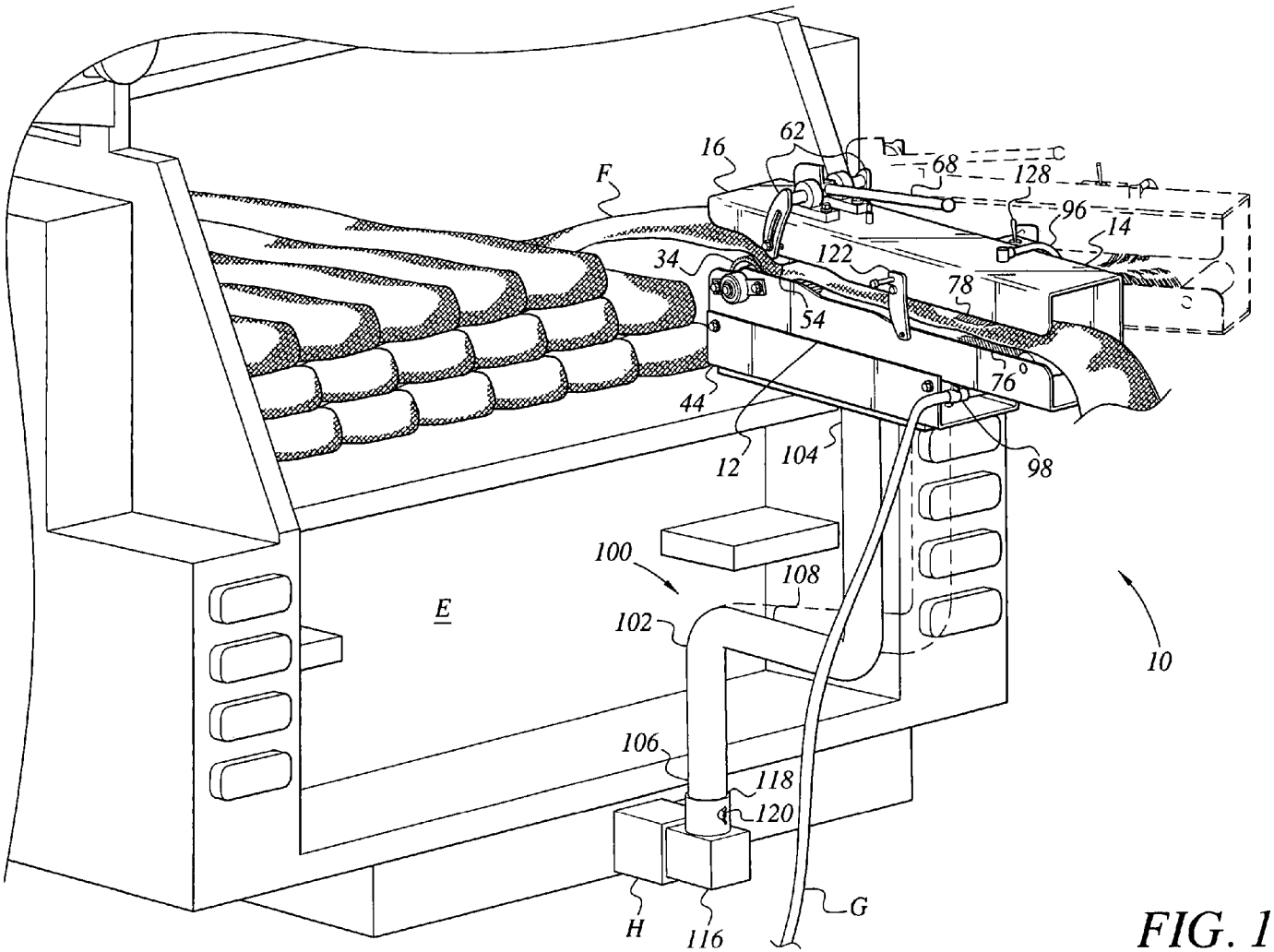
FIG. 1 is an environmental, perspective view of a fire hose retrieval winch according to the present invention, showing its installation on the back of a fire engine hose truck and its general operation.
Figure 2:
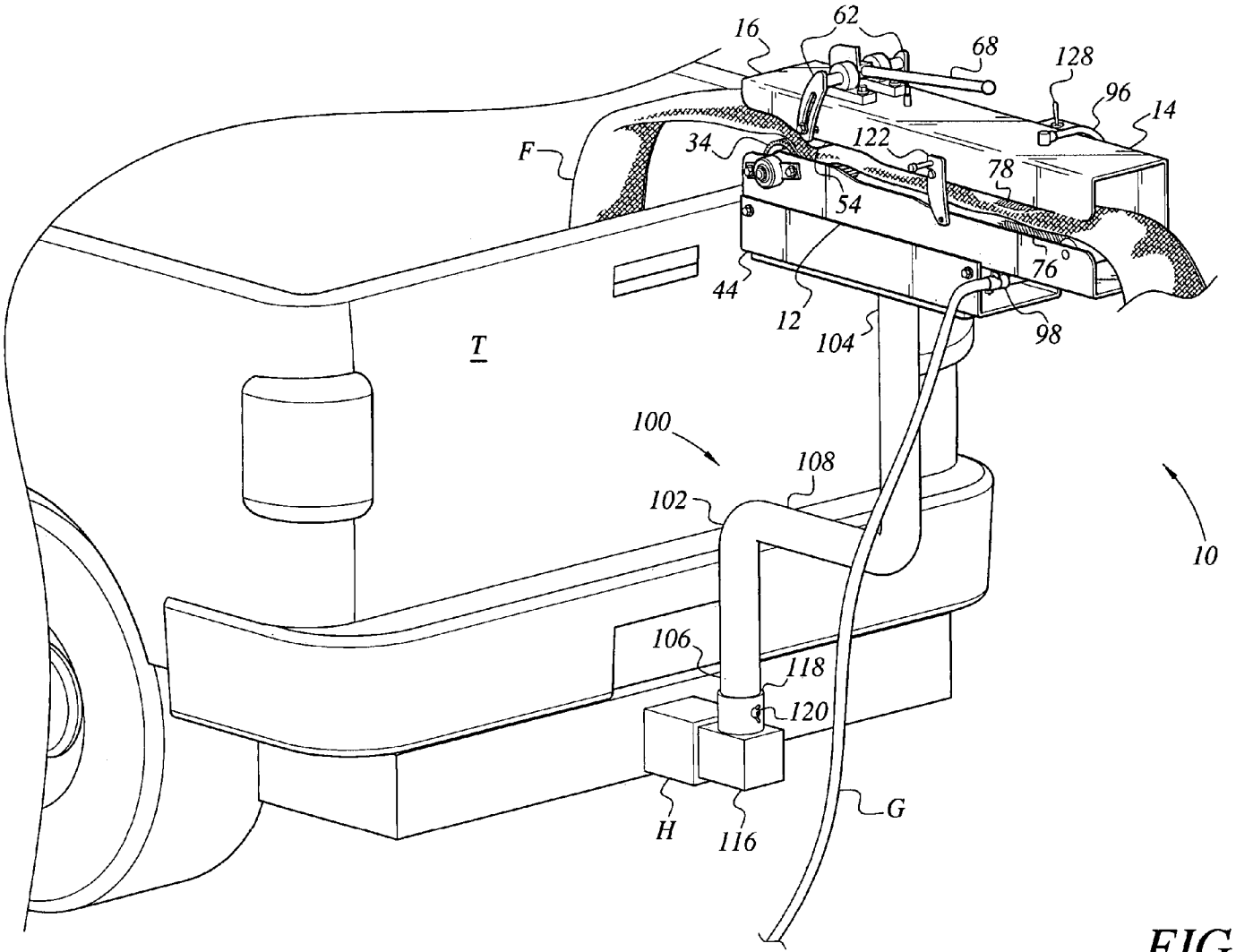
FIG. 2 is an environmental, perspective view of the present fire hose retrieval winch, showing an alternative installation on the back of a light truck and its operation thereon.

The present invention comprises a portable fire hose retrieval winch configured for removable installation upon a fire truck or other vehicle, for cleaning and retrieving lengths of fire hose after they have been deployed at a fire. FIGS. 1 and 2 of the drawings provide environmental perspective views of the present fire hose retrieval winch, designated by the reference numeral 10 throughout the drawings. In FIG. 1, the present hose retrieval winch 10 is shown installed to a conventional receiver hitch socket H on the back of a fire engine E hose truck, while in FIG. 2 the winch 10 is shown installed to an essentially identical receiver hitch socket H extending from the back of a pickup or light truck T.

The present retrieval winch 10 comprises an elongate fire hose transfer housing 12 having an open hose inlet end 14 and opposite open hose outlet end 16, the housing 12 being configured to pass a length of fire hose F therethrough to return the hose F to the vehicle (e.g., fire engine E of FIG. 1, pickup truck T with open bed as shown in FIG. 2, etc.) or other storage area where it may be placed for future use. The present retrieval winch 10 may also be used to clean the exterior surface of the hose F as it passes through the housing 12, as described further below.

Figure 3:
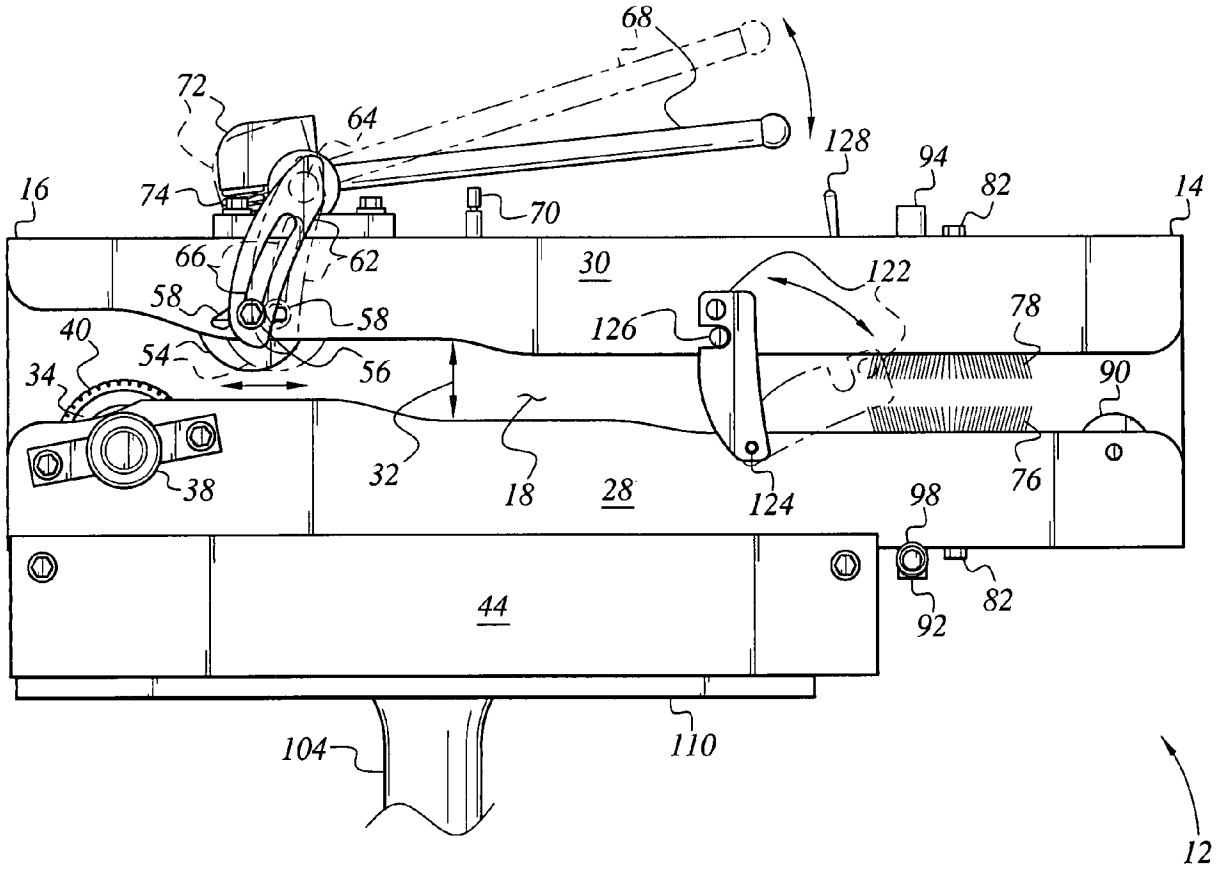
FIG. 3 is a detailed left side elevation view of the upper portion of the fire hose retrieval winch of FIGS. 1 and 2, showing various details thereof.
Figure 4:
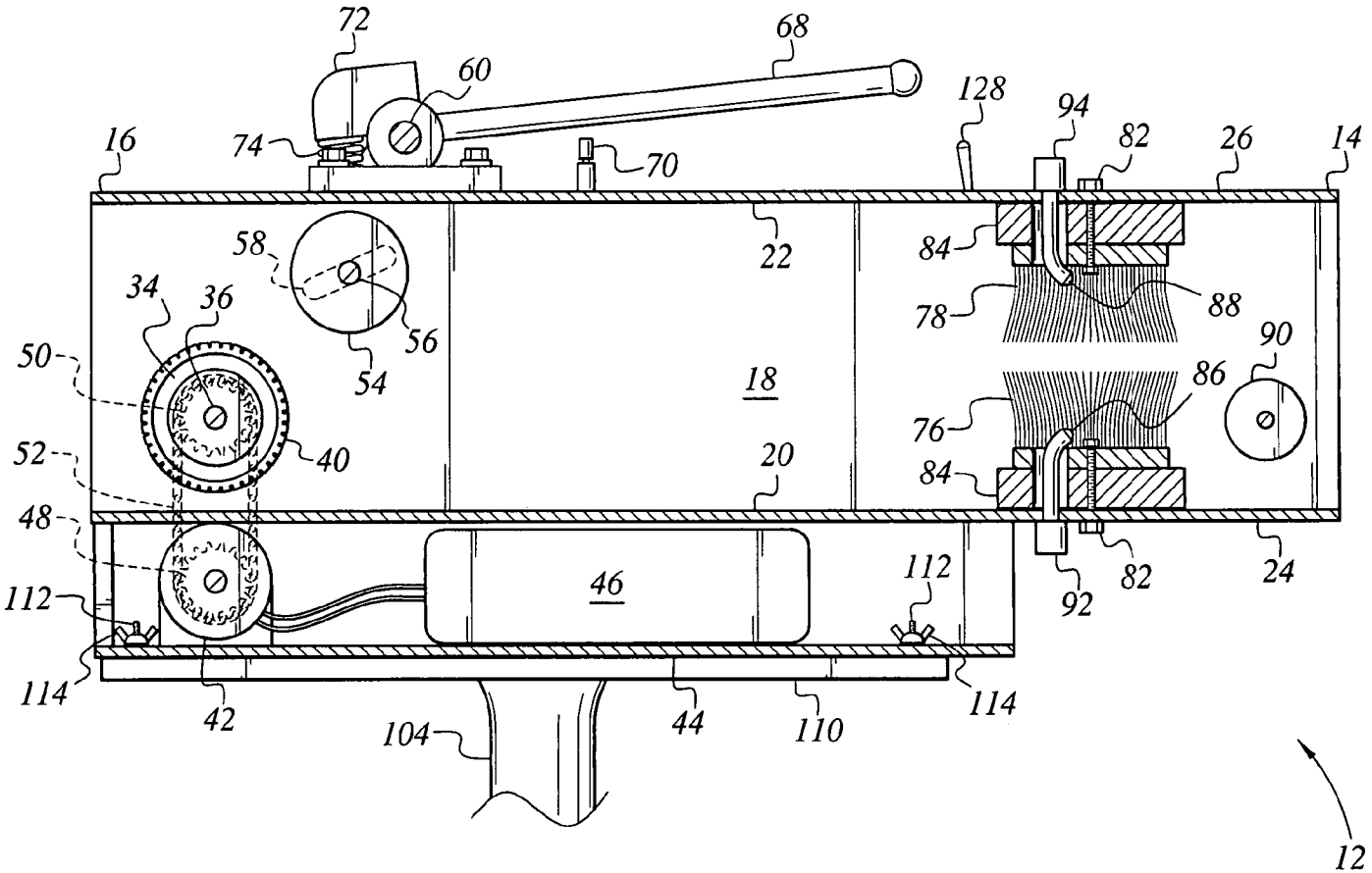
FIG. 4 is a left side elevation view in section of the fire hose retrieval winch of FIGS. 1 through 3, showing further internal details.

FIGS. 3 and 4 provide more detailed views of the structure of the present retrieval winch 10, with FIG. 3 providing a view of the exterior of the device and FIG. 4 being a cross sectional view showing the interior of the device. The hose transfer housing 12 through which the fire hose F passes comprises a closed first wall 18 having opposite lower and upper edges, respectively 20 and 22, from which opposite lower and upper panels, respectively 24 and 26, extend. The two panels 24 and 26 each have a flange extending therefrom opposite the first wall 18, respectively lower flange 28 from the lower panel 24 and upper flange 30 from the upper panel 26. The two flanges 28 and 30 do not extend completely across this side of the hose transfer housing 12, but define a permanently open hose insertion and removal slot 32 therebetween, which extends the entire length of the housing 12.

The hose transfer housing 12 includes a motorized drive roller 34, disposed upon an axle 36 which extends laterally between the first wall 18 and the opposite lower flange 28. The opposite ends of the axle 36 are supported in positionally fixed bearings 38, one of which is illustrated in the external view of the device in FIG. 3. The drive roller 34 preferably includes a cover or coating 40 having a high coefficient of friction, e.g. a textured rubber, etc., in order to provide good grip against a hose F passing thereover.

The drive roller 34 is powered by an electric motor 42, which is housed within a motor and controller housing 44 permanently secured beneath the hose transfer housing 12. The motor and controller housing 44 also contains an electronic control device 46 for the motor 42, which accepts electrical power and controls the speed and torque of the motor 42 depending upon the load imposed thereon. While various sources of electrical power may be used to power the present invention, it is preferred that a relatively low voltage power source be used due to the relatively wet conditions generally encountered when washing down and handling fire hose after its use. The twelve volt nominal electrical power system of the typical vehicle, with which the present hose retrieval winch 10 is used, is ideal for powering the motor 42. Electrical connectors and lines between motor vehicles and other devices, e.g. trailers, etc., are well known and conventional, and may be used to connect the electrical system of the vehicle to the drive motor of the present hose retrieval winch 10.

Various couplers, transmissions, or linkages may be used to transfer rotation from the drive motor 42 to the drive roller 34, e.g. gear trains, belts, etc. FIG. 4 illustrates a drive motor sprocket 48 and drive roller sprocket 50, with a roller chain 52 connecting the two sprockets 48 and 50. The sprocket and chain assembly 48 through 52 is shown in broken lines in FIG. 4, as it is located on the hidden side of the hose transfer housing first wall 18 and the motor and controller housing 44.

Some means must be provided to grip the fire hose F securely against the drive roller 34, in order for the drive roller to impart its rotational torque to the hose F to draw the hose F through the hose retrieval winch 10. This problem is solved by means of an adjustably positionable pressure or pinch roller 54, which is urged by the force of a spring mechanism toward the drive roller 34 to grip the fire hose F therebetween. FIGS. 3 and 4 illustrate this mechanism in detail. The pressure roller 54 is mounted on a laterally disposed axle 56, which rides in pressure axle capture slots 58 formed in the first wall 18 and upper flange 30 of the hose transfer housing 12. The pressure roller axle 56, and thus the pressure roller 54, may move in accordance with the limitations of the slots 58 and the spring mechanism described below, to adjust the pressure against the hose F and drive roller 34.

A pressure roller adjustment shaft 60 is installed laterally across the top of the upper panel 26 of the hose transfer housing 12, with a pressure roller adjustment link 62 immovably affixed to the opposite first and second ends 64 thereof. Only a single shaft end 64 and corresponding link 62 are visible in the side elevation view of FIG. 3, but these components are shown in smaller scale in the perspective views of FIGS. 1 and 2. The two links 62 extend downwardly respectively outside the first wall 18 and upper flange 30 of the hose transfer housing 12, and each includes a pressure roller axle end capture slot 66 therein. The slots 66 capture the respective ends of the pressure roller axle 56 therein. Thus, as the pressure roller adjustment shaft 60 rotates, the two opposed links 62 also rotate in unison therewith, with the captured pressure roller axle 56 being driven by the slots 66 of the two links 62 and carried back and forth in the slots 58 formed in the first wall 18 and upper flange 30 of the hose transfer housing 12, causing the pressure roller 54 to move toward or away from the drive roller 34.

A pressure roller adjustment handle 68 is immovably affixed generally normal to the pressure roller adjustment shaft 60, and extends therefrom. A handle stop 70 may be provided between the handle 68 and the upper panel 26 to provide space between the handle 68 and upper panel 26, as well as to limit the movement of the pressure roller 54 toward the drive roller 34. A rocker arm 72 extends from the pressure roller adjustment shaft 60, generally opposite the handle 68. This rocker arm 72 bears against a compression spring 74, which is captured between the distal end of the rocker arm 72 and the upper panel 26 of the hose transfer housing 12 (or between the arm 72 and a mounting structure for the pressure roller adjustment mechanism). A guard (not shown) may be installed about the spring 74, if desired.

The compression spring 74 urges the rocker arm 72 upwards, thereby applying a clockwise force upon the pressure roller adjustment shaft 60. This in turn tends to rotate the two pressure roller adjustment links 62 in a clockwise direction, with their lower ends and pressure roller axle end capture slots 66 being urged to the left in FIG. 3. This forces the pressure roller axle 56, and thus the pressure roller 54, toward the drive roller 34, thereby securely gripping a fire hose or the like therebetween during operation:

The above described mechanism results in a substantially uniform gripping pressure upon a hose or the like passing between the two rollers 34 and 54. However, it also compensates for any relatively small obstructions or debris which may have adhered to the hose, and which were not removed during the hose cleaning process. In the event that some obstruction (e.g., a piece of gravel which has adhered to the hose, etc.) passes between the two rollers 34 and 54, the obstruction will force the pressure roller 54 away from the drive roller 34, causing the pressure roller adjustment linkage to rotate slightly in a counterclockwise direction and further compressing the spring 74. When the obstruction has passed, the compression spring 74 returns the mechanism to its normal state.

The above described mechanism serves to draw a fire hose F or the like through the hose transfer housing 12, while simultaneously adjusting the gripping pressure on the hose and compensating for any obstructions or debris which may have adhered to the hose. However, the present invention is also capable of cleaning the hose as it passes through the hose transfer housing 12, using two different cleaning principles if so desired.

The first cleaning means encountered as a hose passes through the device comprises a pair of brushes, respectively a lower brush 76 and an opposite upper brush 78. These two brushes extend from the inlet end 14 of the hose transfer housing 12, respectively secured within or adjacent to the lower panel 24 and upper panel 26 of the housing 12. The brushes 76 and 78 are removably secured in place by bolts 82, and the brush assembly may include one or more spacer blocks 84 to position the bristles with proper spacing to bear against a hose passing therebetween with the proper pressure and scrubbing action. Alternatively, clips or other attachment means (not shown) may be used to secure the brushes 76 and 78 in place, rather than the bolts 82 illustrated. The two brushes 76 and 78 remain stationary relative to the housing 12 structure, with the movement of the hose between the two brushes 76 and 78 as the hose is drawn through the housing 12, resulting in relative movement between the hose and the bristles of the brushes 76 and 78 to scrub the surface of the hose.

A water washdown may also be provided in addition to or in lieu of the brush cleaning means described above, if so desired. The hose transfer housing 12 includes a lower wash nozzle 86 and an opposite upper wash nozzle 88 respectively extending from the lower panel 24 and upper panel 26 to the interior of the housing 12 and respectively through the bases of the lower and upper brushes 76 and 78, as shown in FIG. 4 of the drawings. An idler roller 90 may be provided across the lower portion of the hose transfer housing 12, adjacent the inlet end 14 of the device, in order to support a fire hose F passing into the device. This is especially critical if the brushes 76 and 78 are not installed. The two nozzles 86 and 88 receive water from respective lower and upper fittings 92 and 94, which are interconnected by a length of hose 96 (shown in FIGS. 1 and 2) disposed externally to the hose transfer housing 12 in order to avoid contact or interference with a fire hose F or other internal components within the housing 12. A conventional garden hose G or the like may be connected to the lower nozzle fitting 92, with a conventional shutoff valve 98 being placed between the end of the hose G and the lower fitting 92. The nozzles 86 and 88 pass through the bases of the brushes 76 and 78 and are oriented toward the inlet end 14 of the hose transfer housing 12, to apply a water spray in the direction of the incoming hose as it passes through the inlet end 14 of the device and between the two brushes 76 and 78. If water washdown is not desired, the garden hose G may remain unattached to the device, or the shutoff valve 98 may remain closed, if so desired.

The above described fire hose retrieval winch assembly 10 is relatively compact and light weight, and lends itself well to portability. It is anticipated that the present winch device 10 will be carried within a storage compartment on a fire truck and deployed after a fire has been put out, in order to gather and draw the deployed hose back to the truck and clean the hose before it is replaced on the truck. Accordingly, some form of temporary mounting or attachment means is required for the present hose retrieval winch 10.

FIGS. 1 and 2 illustrate a vehicle attachment assembly 100 which may be provided and used with the hose transfer housing assembly 12. In FIG. 1 the assembly 100 is shown secured to a conventional receiver hitch socket or receptacle H extending from the rear of a fire engine E hose truck, while in FIG. 2 the assembly is shown secured to such a hitch socket H extending from the rear of a light pickup truck T. However, the hose retrieval winch 10 and its attachment assembly 100 is the same in both cases.

The vehicle attachment assembly 100 essentially comprises a vehicle attachment post 102 having an upper end 104 which secures removably to the hose transfer housing 12, and an opposite lower end 106 which secures removably to the fire engine E, truck T or other vehicle. The medial portion 108 of the post 102 includes an offset bend therein, or more correctly, a pair of opposite offset bends which result in the upper portion 104 being parallel to the lower portion 106, but axially offset therefrom. This provides clearance from the vehicle structure, and also allows the upper end 104 with its attached hose transfer housing 12 to be positioned or swung in an arc defined by the length of the medial offset portion 108 of the post 102, generally as shown by the alternate position of the mechanism shown in broken lines in FIG. 1 of the drawings. While only a single alternate position is illustrated in FIG. 1 for clarity in the drawing Fig., it will be understood that the mechanism 10 may be pivoted or swung in either direction from its central position shown in solid lines, limited only by the vehicle structure to which it is attached.

The attachment of the upper end portion 104 of the post 102 to the hose transfer housing 12 is shown in detail in FIGS. 3 and 4. As the motor and controller housing 44 is secured beneath the hose transfer housing 12, the upper end 104 of the post 102 actually secures to the motor and controller housing 44, rather than directly to the hose transfer housing 12. However, the effect is the same, as all of the components 12, 44, and 102 are rigidly and immovably secured together. The upper end portion 104 of the attachment post 102 includes a mounting plate 110 extending thereacross, with the plate 110 having a series of threaded studs 112 extending upwardly therefrom. A matching series of conventional attachment holes or passages (not shown) is provided through the floor of the motor and controller housing 44. The hose transfer housing 12 and its attached motor and controller housing 44 are placed atop the attachment post mounting plate 110, and removably secured thereto by a corresponding series of wing nuts 114 which engage the studs 112. The wing nuts 114 are easily accessible through the open ends of the motor and controller housing 44, enabling the hose transfer housing 12 and motor and controller housing 44 to be quickly and easily installed upon or removed from the attachment post mounting plate 110 as desired.

The lower end 106 of the attachment post 102 secures removably to a receiver hitch attachment fitting 116, which in turn secures removably to a conventional receiver hitch socket H provided on the fire engine E or other truck or vehicle T. The fitting 116 includes a generally vertical socket or collar 118, into which the lower end 106 of the attachment post 102 may be inserted. A thumb screw 120 passes through a threaded hole in the collar 118 to secure the extreme lower end 106 of the attachment post 102 adjustably therein. The clamping pressure of the thumb screw 120 may be adjusted as desired to adjust the frictional resistance to rotation of the attachment post 102, but allowing the post 102 to swivel as required.

The present fire hose retrieval winch 10 greatly facilitates the retrieval and replacement of a fire hose on a fire vehicle after the hose has been deployed at a fire. The hose transfer housing 12 and its vehicle attachment assembly 100 are removed from their storage area(s) on the fire truck or other vehicle, and the attachment assembly 100 is secured to the receiver hitch H of the engine E, truck T or other vehicle with which the winch 10 is to be used. The hose transfer housing 12 is then secured atop the mounting plate 110 which is affixed to the upper end 104 of the attachment post 102, if it has not previously been secured to the post 102 prior to installing the attachment assembly 100 on the vehicle. An electrical power source, e.g. conventional electrical connection from the engine E or truck T to which the transfer housing 12 and attachment assembly 100 have been installed, is connected to the winch 10 to power the electric drive motor 42 therein. Finally, a water supply, e.g. conventional garden hose G, may be connected to the lower nozzle fitting 92 with its hose inlet, if water washdown of the fire hose F is to be used.

The fire hose retrieval winch 10 is used by placing the leading portion of a fire hose F through the hose insertion and removal slot 32 of the hose transfer housing 12, with the conventional rigid hose coupling extending slightly beyond the outlet end 16 of the transfer housing 12. Conventional fire hoses have a flat cross section in their relaxed state when they are not filled with water, which permits more compact storage of a lengthy section or several sections of hose. This flat hose configuration permits the fire hose F to be inserted easily within the hose insertion and removal slot 32 of the hose transfer housing 12, with the various brushes and rollers of the housing 12 bearing against the flat surfaces of the flattened fire hose F. The fire hose F is positioned between the two brushes 76 and 78, over the idler support roller 90, and between the drive roller 34 and pressure roller 54. The pressure roller adjustment handle 68 is lifted to draw the pressure roller 54 away from the drive roller 34, to facilitate insertion of the fire hose F.

Once the fire hose F has been positioned within the hose transfer housing 12, a retaining latch 122 may be secured in place across the hose insertion and removal slot 32 between the two flanges 28 and 30. The latch 122 is secured upon a pivot pin 124 to the lower flange 28, and pivots upwardly to hook to a pin 126 extending from the upper flange 30. It should be noted that the latch 122 does nothing to secure the upper and lower portions of the hose transfer housing 12 together, as all of the wall and panel components forming the housing 12, i.e. the first wall 18, lower and upper panels 24 and 26, and lower and upper flanges 28 and 30, are rigidly secured to one another (e.g., welded, forged as a single, unitary structure, etc.) and do not move relative to one another. The purpose of the latch 122 is only to prevent the fire hose F from "walking" or working laterally from the rollers and out of the gap or slot 32 as it passes longitudinally through the transfer housing 12. A second and/or third latch (not shown) may be installed near the outlet and/or inlet end(s) 16 and/or 14 of the assembly, if so desired.

Once the fire hose F has been installed within the housing 12 and the retaining latch 122 closed, the water supply may be turned on by opening the shutoff valve 98 and/or opening the faucet or outlet to which the hose G has been connected, if water washdown of the fire hose F is desired. The drive roller motor 42 is actuated by an electrical switch 128 extending from the housing 12, or from another structure (not shown) attached to the housing 12. This structure would be on the opposite side of the housing 12 as it is shown in the drawings, and may include a chain guard disposed about the drive motor sprocket 48, drive roller sprocket 50, and chain 52. The switch 128 is preferably spring loaded to a normally open or off condition, requiring the switch to be held in the closed position in order to keep the drive motor 42 and drive roller 34 in operation. Preferably, the switch 128 will automatically return to its normally open condition to shut off power to the drive motor 42, if pressure is released by the operator. While a toggle switch is illustrated, it should be noted that other switch configurations, e.g. rocker, pushbutton, etc., may be used if so desired.

The combination of the brushes 76 and 78 and water washdown provided by the nozzles 86 and 88, remove substantially all of the dirt, grime, and debris which typically accumulate on the exterior covering of fire hoses when in use. The drive roller 34 and its opposite pressure roller 54 not only serve to draw the fire hose F through the hose transfer housing 12, but also compress the hose F to force any remaining water from the hose, where it escapes from the trailing end of the hose. The fire hose F, with all water removed, is capable of being stored much more readily due to the lightened weight and more compact volume.

As the cleaned fire hose F passes from the outlet end 16 of the hose transfer housing 12, a firefighter or other person may gather the fire hose F and position it for storage in the back of the fire engine E, truck T or other vehicle as desired, where it is ready for deployment on the next occasion where use is required. The powered hose retrieval mechanism greatly facilitates the gathering of the relatively heavy hose, requiring that only a relatively short length of the hose extending from the hose transfer housing 12, actually be lifted and manipulated. This enables the hose to be placed for storage much more rapidly than when the entire length of hose, weighing perhaps in excess of one hundred pounds, must be handled manually. The swiveling action of the vehicle attachment assembly 100 further facilitates the handling of the hose, by allowing the hose transfer housing 12 to swing in an arc to redirect the fire hose F exiting the outlet end 16 of the transfer housing 12 as desired.

When the length of fire hose F has passed through the hose transfer housing 12, the hose coupling at the trailing end of the hose prevents further passage of the hose through the machine. At this point, the operator releases the switch 128 to stop the drive roller motor 42, opens the hose retainer latch(es) 122, and removes the trailing portion of the fire hose F from the machine for placement in the fire truck T. The process is repeated as many times as necessary to clean and retrieve all of the previously deployed fire hose for storage on the truck. Once all of the fire hose F has been retrieved and repositioned on the truck, the water supply is shut off, the hose disconnected, the electrical supply disconnected, and the vehicle attachment assembly 100 and hose transfer housing 12 removed from the engine E, truck T or other vehicle and stored for future use.

In conclusion, the present fire hose retrieval winch provides a much needed means for firefighters to retrieve, clean, and store fire hoses after use. While various other devices have been developed in the past with the aim of performing a similar function, the present fire hose retrieval winch is considerably lighter and more compact than most of the devices previously developed. Where relatively light weight and portable devices have been developed in the past, they generally do not provide all of the functions of the present hose retrieval winch. Accordingly, the present fire hose retrieval winch will find great favor among firefighters and others who have need to handle relatively large and massive lengths of hose and who require a portable piece of equipment for such work.

It is to be understood that the present invention is not limited to the embodiment described above, but encompasses any and all embodiments within the scope of the following claims.

We claim:

1. A fire hose retrieval winch, comprising:

an elongate hose transfer housing, having:

an elongated upper wall, an elongated lower wall and an elongated side wall joining the upper wall and the lower wall in order to define an elongated C-shaped channel, the upper wall and the lower wall each having an elongated edge opposite the side wall;

an upper flange depending from the elongated edge of the upper wall parallel to the side wall;

a lower flange rising from the elongated edge of the lower wall parallel to the side wall, the upper and lower flanges defining an elongated hose insertion and removal slot between the upper and lower flanges, the channel having open opposite ends for passing a fire hose through the hose transfer housing;

a positionally fixed drive roller axle laterally disposed between the side wall and the lower flange of the hose transfer housing;

a motorized drive roller disposed upon the drive roller axle;

an adjustably positionable pressure roller axle laterally disposed between the side wall and the upper flange of the hose transfer housing;

an adjustably positionable pressure roller disposed upon the pressure roller axle;

a spring mechanism attached to the pressure roller and urging the pressure roller toward the drive roller; and at least one hose retaining latch selectively positioned across said hose insertion and removal slot.

2. The fire hose retrieval winch according to claim 1, further including:

a vehicle attachment assembly, having:

a vehicle attachment post, having an upper end removably affixed to said hose transfer housing, a medial offset bend portion, and a lower end; and a receiver hitch attachment fitting, removably secured to the lower end of said vehicle attachment post.

3. The fire hose retrieval winch according to claim 2, wherein the lower end of said vehicle attachment post further comprises a frictionally adjustable swivel.

4. The fire hose retrieval winch according to claim 1, further including:

a motor and controller housing depending below said hose transfer housing and permanently affixed thereto;

an electric motor disposed within said motor and controller housing; and a drive assembly including a pair of sprockets and a chain extending therebetween for transferring power between said electric motor and said drive roller.

5. The fire hose retrieval winch according to claim 4, further including a vehicle attachment post, having at least an upper end removably affixed to said motor and controller housing.

6. The fire hose retrieval winch according to claim 1, further including:

a pressure axle capture slot disposed respectively in said first wall and in said upper flange of said hose transfer housing;

a laterally disposed pressure roller adjustment shaft atop said upper panel of said hose transfer housing, said pressure roller adjustment shaft further having a first end and a second end opposite said first end;

a pressure roller adjustment link immovably affixed to each said end of said pressure roller adjustment shaft, and extending therefrom;

a pressure roller axle end capture slot disposed within each said pressure roller adjustment link, adjustably capturing said pressure roller axle therein;

a pressure roller adjustment handle generally normal and immovably affixed to said pressure roller adjustment shaft, and extending therefrom;

a rocker arm extending from said pressure roller adjustment shaft, opposite said pressure roller adjustment handle; and a compression spring disposed between said rocker arm and said upper panel of said hose transfer housing, urging said pressure roller toward said drive roller by means of said rocker arm, said pressure roller adjustment shaft, and each said pressure roller adjustment link adjustably acting upon said pressure roller axle.

7. The fire hose retrieval winch according to claim 1, further including an upper brush and a lower brush each removably disposed adjacent said inlet end of said hose transfer housing.

8. The fire hose retrieval winch according to claim 1, further including an upper spray nozzle and a lower spray nozzle each disposed adjacent the inlet end of said hose transfer housing.

9. The fire hose retrieval winch according to claim 8, further including an externally disposed transfer hose connecting said lower spray nozzle to said upper spray nozzle.

10. A fire hose retrieval winch, comprising:

a hose transfer housing, including:

an open hose inlet end;

an open hose outlet end, opposite said hose inlet end;

a closed first wall;

a closed lower panel extending from said first wall, and immovably affixed thereto;

a closed upper panel extending from said first wall, immovably affixed thereto and opposite said lower panel;

a lower flange immovably affixed to and extending from said lower panel opposite said first wall;

an upper flange immovably affixed to and depending from said upper panel opposite said first wall;

said lower flange and said upper flange defining an elongate, permanently open hose insertion and removal slot there between;

a positionally fixed drive roller axle laterally disposed between said first wall and said lower flange of said hose transfer housing;

a motorized drive roller disposed upon said drive roller axle;

an adjustably positionable pressure roller axle laterally disposed between said first wall and said upper flange of said hose transfer housing;

an adjustably positionable pressure roller disposed upon said pressure roller axle; and a spring mechanism. urging said pressure roller toward said drive roller; and a vehicle attachment assembly, having:

a vehicle attachment post having an upper end removably affixed to said hose transfer housing, a medial offset bend portion, and a lower end;

a receiver hitch attachment fitting, removably secured to the lower end of said vehicle attachment post.

11. The fire hose retrieval winch according to claim 10, wherein the lower end of said vehicle attachment post comprises a frictionally adjustable swivel.

12. The fire hose retrieval winch according to claim 10, further including:

a motor and controller housing depending below said hose transfer housing and permanently affixed thereto;

an electric motor disposed within said motor and controller housing; and a drive assembly including a pair of sprockets and a chain extending therebetween for transferring power between said electric motor and said drive roller.

13. The fire hose retrieval winch according to claim 12, wherein the upper end of said vehicle attachment post is removably affixed to said motor and controller housing.

14. The fire hose retrieval winch according to claim 10, further including:

a pressure axle capture slot disposed respectively in said first wall and in said upper flange of said hose transfer housing;

a laterally disposed pressure roller adjustment shaft atop said upper panel of said hose transfer housing, said pressure roller adjustment shaft further having a first end and a second end opposite said first end;

a pressure roller adjustment link immovably affixed to each said end of said pressure roller adjustment shaft, and extending therefrom;

a pressure roller axle end capture slot disposed within each said pressure roller adjustment link, adjustably capturing said pressure roller axle therein;

a pressure roller adjustment handle generally normal and immovably affixed to said pressure roller adjustment shaft, and extending therefrom;

a rocker arm extending from said pressure roller adjustment shaft, opposite said pressure roller adjustment handle; and a compression spring disposed between said rocker arm and said upper panel of said hose transfer housing, urging said pressure roller toward said drive roller by means of said rocker arm, said pressure roller adjustment shaft, and each said pressure roller adjustment link adjustably acting upon said pressure roller axle.

15. The fire hose retrieval winch according to claim 10, further including an upper brush and a lower brush each removably disposed adjacent said inlet end of said hose transfer housing.

16. The fire hose retrieval winch according to claim 10, further including an upper spray nozzle and a lower spray nozzle each disposed adjacent said inlet end of said hose transfer housing.

17. The fire hose retrieval winch according to claim 16, further including an externally disposed transfer hose connecting said lower spray nozzle to said upper spray nozzle.

18. The fire hose retrieval winch according to claim 10, further including at least one hose retaining latch selectively positioned across said hose insertion and removal slot.

* * * * *